US005701611A

United States Patent [19]

Rector et al.

[11] Patent Number: 5,701,611

[45] Date of Patent: Dec. 30, 1997

[54] PROTECTIVE PAD CONSTRUCTION

[75] Inventors: James L. Rector, Vienna, W. Va.; Edward H. Tobergte, Fairfield, Ohio

[73] Assignee: Ed Tobergte Associates, Inc., Fairfield, Ohio

[21] Appl. No.: 567,547

[22] Filed: Dec. 5, 1995

[51] Int. Cl.[6] ..... A41D 13/00

[52] U.S. Cl. ..... 2/455; 2/462; 2/267; 2/268

[58] Field of Search ..... 2/59, 61, 62, 455, 2/456, 459, 460, 461, 462, 463, 464, 465, 466, 467, 414, 267, 268; 428/158

[56] References Cited

U.S. PATENT DOCUMENTS

| | | | |
|---|---|---|---|
| 2,251,018 | 7/1941 | Lookabaugh | 2/462 |
| 2,957,177 | 10/1960 | Turner | 2/462 |
| 3,044,075 | 7/1962 | Rawlings . | |
| 3,125,762 | 3/1964 | Glahe | 2/463 |
| 3,248,738 | 5/1966 | Morgan . | |
| 4,486,901 | 12/1984 | Donzis . | |
| 4,590,622 | 5/1986 | Wolfe et al. | 2/462 |
| 5,020,156 | 6/1991 | Neuhalfen | 2/462 |
| 5,173,964 | 12/1992 | Ball et al. | 2/467 |

*Primary Examiner*—C. D. Crowder
*Assistant Examiner*—Larry D. Worrell, Jr.
*Attorney, Agent, or Firm*—Chase & Yakimo

[57] ABSTRACT

An athletic protective pad comprising a foam body composed of a layer of open cell foam and a first and second layer of closed cell foam and having a foam chest portion, a foam shoulder member and a hinge attaching the chest portion to the shoulder member, with the chest portion and shoulder member each presenting a periphery. The hinge member includes tape attached to an outer surface of the foam body across a portion of the peripheries of the chest portion and shoulder member to allow the shoulder member to rotate in a first direction relative to the chest portion and preventing rotation thereof in a second direction. The first and second layers of closed cell foam are secured to opposing surfaces of the open cell foam layer, with the layers presenting a sandwich configuration. The layer of open cell foam has a first thickness and the layers of closed cell foam each have a second thickness, where the first thickness of the open cell foam is approximately 1.8 times the second thicknesses of the closed cell foam to maximize the trapped air content within the layer of open cell foam and thus, improve the pad's impact resistance.

8 Claims, 4 Drawing Sheets

PROTECTIVE PAD CONSTRUCTION

FIELD OF THE INVENTION

This invention relates to an improved athletic protective pad construction having a foam configuration that maximizes impact resistance for a selected pad thickness. Additionally, the invention relates to football shoulder pads and the like having an improved hinge device connecting the deltoid portion of the pads to the chest portion of the pads.

BACKGROUND OF THE INVENTION

Athletic protective pads, such as shoulder pads, rib protectors, hip pads, thigh pads, and so forth, are commonly worn by athletes in a variety of sports in which body contact with either another participant or a piece of equipment used in the sport presents the risk of injury. These types of protective pads have long been known and used by athletes in contact sports such as football, hockey and so forth.

Football shoulder pads typically include a relatively hard outer shell of leather, rigid plastic or similar material and an inner layer of soft padding material. The hard outer layer receives the applied force or shock upon impact and spreads the force over a large area where it is. absorbed and cushioned by the soft padding material. Padding materials may include cotton padding, foam rubber, foam plastic, sponge rubber, expanded rubber or vinyl with the properties of such materials having the ability to reduce transmitted force during impact.

Padding composed of a combination of open and closed cell foams has also been utilized. However, these and other types of padding typically do not provide adequate impact resistance under all contact conditions and/or the padding can be heavy and cumbersome which reduces an athlete's speed and mobility.

The construction of football shoulder pads may further decrease an athlete's mobility. Shoulder pads are typically constructed to include padding that extends across an athlete's chest and back area as well as partially across the front and back shoulder region. A football player's arm movement may be limited by such pads which do not include an adequate hinge device between the chest and shoulder areas.

SUMMARY OF THE INVENTION

Accordingly, a primary object of the subject invention is to provide an athletic protective pad having a foam body which includes a chest portion, a shoulder portion and a hinge for attaching the chest portion to the shoulder portion, where the hinge includes tape attached to an outer surface of the foam body across a portion of the peripheries of the chest and shoulder portions to allow rotation of the shoulder portion in a first direction relative to the chest portion and prevent rotation thereof in a second direction.

Another primary object of the subject invention is to provide an athletic protective pad having a foam portion composed of a layer of open cell foam and first and second layers of closed cell foam secured to opposing surfaces of the open cell foam, where the open cell foam layer is approximately 1.5 to 2.0 times the thicknesses of the layers of closed cell foam.

A further object of the subject invention is to provide an athletic protective pad which maximizes the trapped air content therein for a selected pad thickness.

Yet another object of the subject invention is to provide an athletic protective pad that does not significantly affect an athlete's mobility.

Still a further object of the subject invention is to provide a shoulder pad having improved impact resistance and lower weight consistent with economical fabrication.

These objects are attained by providing an athletic protective pad comprising a foam body composed of a layer of open cell foam and a first and second layer of closed cell foam and having a foam chest portion, a foam shoulder member and a hinge attaching the chest portion to the shoulder member, with the chest portion and shoulder member each presenting a periphery. The hinge member includes tape attached to an outer surface of the foam body across a portion of the peripheries of the chest portion and shoulder member to allow the shoulder member to rotate in a first direction relative to the chest portion and prevent rotation thereof in a second direction. The first and second layers of closed cell foam are secured to opposing surfaces of the open cell foam layer to present a sandwich configuration. The layer of open cell foam has a first thickness and each of the layers of closed cell foam has a second, lesser thickness, where the first thickness of the open cell foam is approximately 1.5 to 2.0 times the second thicknesses to maximize the trapped air content within the layer of open cell foam and thus, improve the pad's impact resistance.

The athletic protective pad also preferably includes a sealing member which partially seals the chest portion and shoulder member. The sealing member is secured around the peripheries thereof to inhibit the release of air upon impact. The sealing member is preferably formed of tape secured to the respective peripheries.

Other objects and advantages of this invention will become apparent from the following description taken in connection with the accompanying drawings, wherein is set forth by way of illustration and example, an embodiment of this invention.

DETAILED DESCRIPTION

Figure 1:
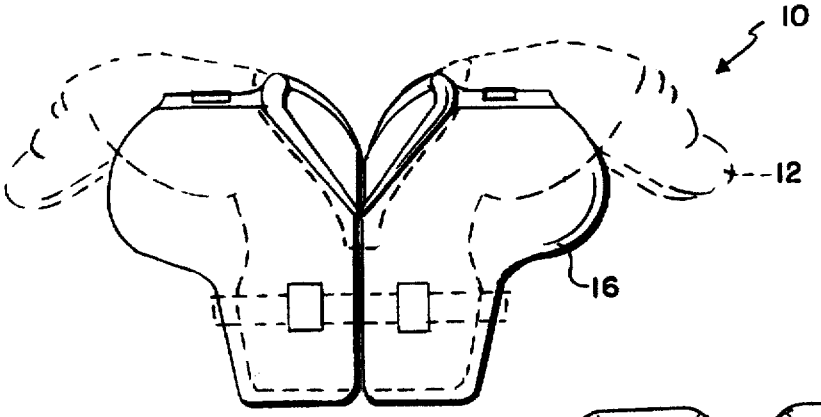
FIG. 1 is a frontal perspective view of an athletic pad in accordance with the present invention, with the pad's hard outer covering shown in phantom.
Figure 2:
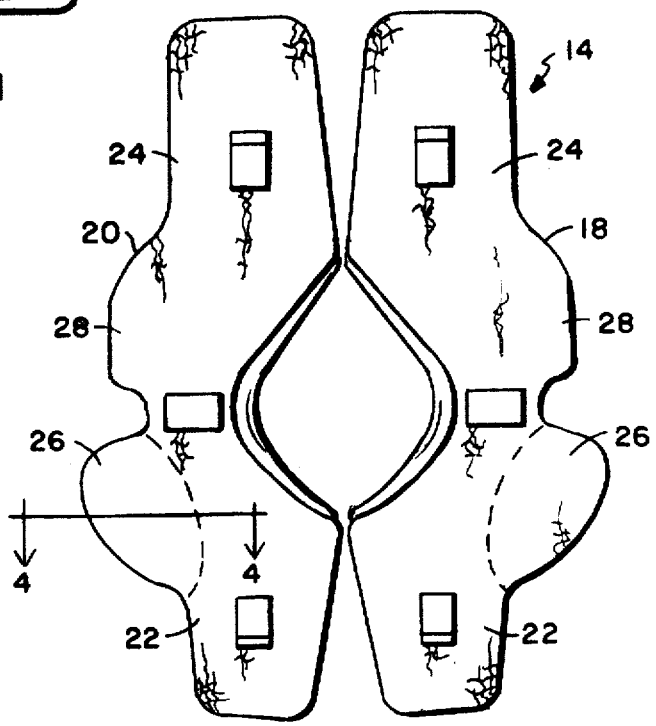
FIG. 2 is a top view of the shoulder pad of FIG. 1.

An athletic protective pad 10 in accordance with the present invention is shown in FIG. 1. Protective pad 10 includes three layers; a hard outer covering 12 substantially covers a soft padding layer 14 which is received within the cavity formed by breathable cloth covering 16. See FIGS. 1 and 4. Hard outer covering 12 is typically formed of rigid plastic and receives the applied force upon impact and spreads the force over a large area where it is absorbed and cushioned by the soft padding layer 14. To sufficiently protect the athlete's upper torso, athletic protective pad 10 includes left and right halves 18 and 20. Each half is identical but a mirror image of the other and includes a chest portion 22, a back portion 24, a front shoulder member or deltoid pad 26 and a back shoulder member 28, as shown in FIG. 2.

Figure 3:
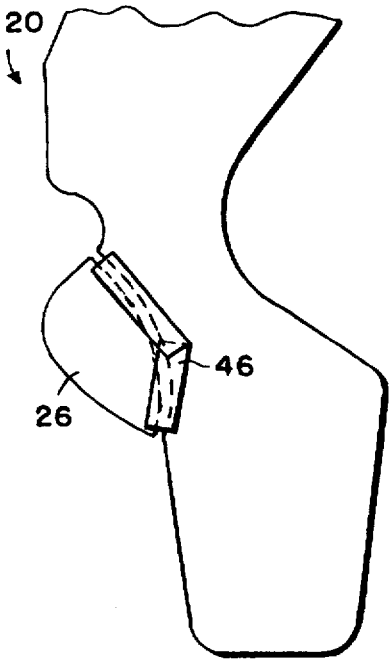
FIG. 3 is a partial front view of the left side of the shoulder pad of FIG. 1 with the cloth covering removed therefrom to show the hinge member between the shoulder and chest portions of the pad.
Figure 4:
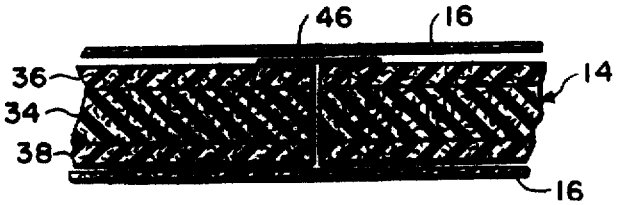
FIG. 4 is a greatly enlarged, fragmentary cross-section taken along line 4—4 of FIG. 2.

The padding layer 14 is typically ½"–1½" thick, depending on the role of the athlete, his or her weight and mobility, cost and other considerations. Padding layer 14 is composed of three layers, a layer of open cell foam 34 and two layers of closed cell foam 36 and 38 as seen in FIG. 4. The layer 14 also includes a partial sealing member 42, preferably formed of tape secured around the periphery of each deltoid pad 28 as well as around the periphery of each right and left half 18 and 20. See FIG. 7. Padding layer 14 further includes two hinge members 46 (only one shown) which hingedly connect each chest portion 22 to its corresponding deltoid pad 26, as in FIG. 3.

The two layers of closed cell foam 36 and 38 are secured to opposing surfaces of the open cell foam layer 34 to present a sandwich configuration, as seen in FIGS. 4, 5, 7 and 8. Closed cell foam layer 36 forms the outer surface of padding layer 14 and is adjacent hard outer covering 12 of protective pad 10. Closed cell foam layer 38 forms the inner surface of padding layer 14 and is adjacent the athlete's body when in use.

The closed cell foam layers 36 and 38 are substantially the same thickness and are relatively thin compared to the open cell foam layer 34. In one specific embodiment, for example, each closed cell layer 36 and 38 is 4 millimeters thick with the open cell layer 34 being 15 millimeters thick. In another embodiment (not shown), closed cell layer 36 is 6 millimeters thick, closed cell layer 38 is 4 millimeters thick and open cell layer 34 is 18 millimeters thick. These thicknesses may vary slightly depending on the role of the athlete, etc., but it is preferable to have approximately a 1.8 to 1 thickness ratio between the open and closed cell layers. In general, the open cell layer's thickness should comprise 60–66 percent of the padding's total thickness, with each of the closed cell layers comprising 17–20 percent of the padding's total thickness.

Figure 8:
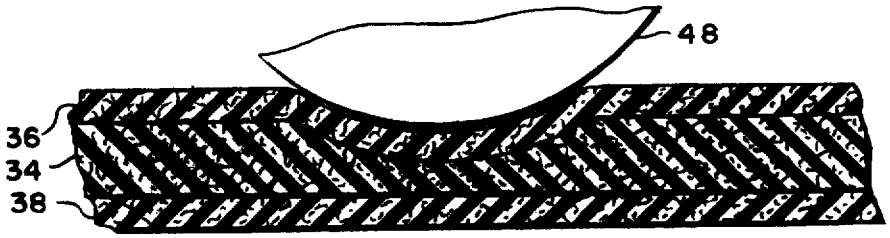
FIG. 8 is a fragmentary, cross-sectional view of the padding illustrating impact with a football helmet.
Figure 9:
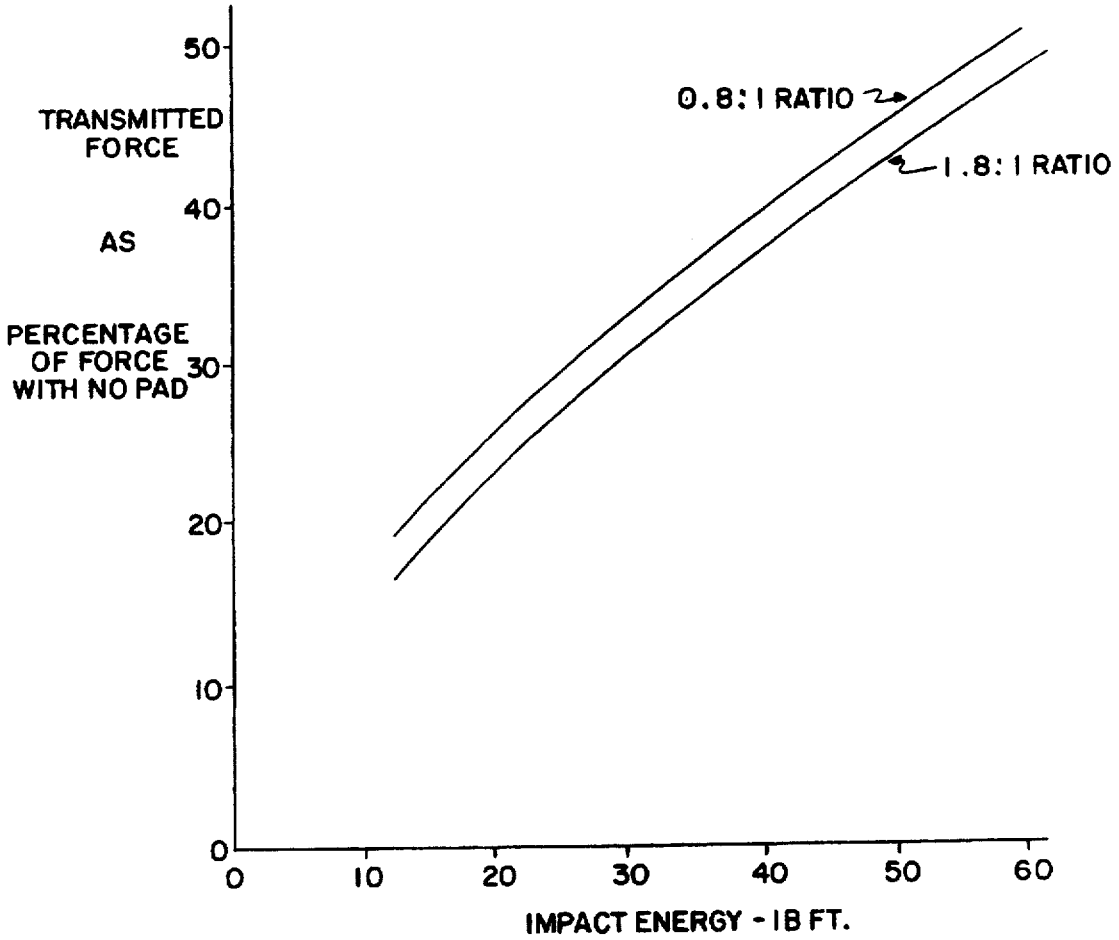
FIG. 9 is a graph showing the reduction of transmitted force by increasing the ratio of open to closed cell foam in the padding.

The advantageous effects that these thicknesses have on padding 14 are shown in FIG. 9 which compares a prior art pad having a 0.8 to 1 thickness ratio to the pad disclosed herein. FIG. 9 shows the reduction of transmitted force when the percentage of open cell foam is increased as discussed above. Thus, in use, the pad 10 composed of padding 14 is much less likely to "bottom out" than prior art padding upon impact with a football helmet 48 or other object as illustrated in FIG. 8.

In further detail, the open cell foam layer 34 has a preferable density of 0.04 grams/cc or 2.5 lb/cubic foot. The outer closed cell foam layer 36 has a density of 0.11 grams/cc or 6.9 lb/cubic foot, and the inner closed cell foam layer 38 has density of 0.10 grams/cc or 6.2 lb/cubic foot. The closed cell foam is preferably composed of a major amount of nitrile rubber, formed from the copolymers of butadiene and acrylonitrile, and a minor amount of polyvinyl chloride, and the open cell foam is preferably composed of polyester.

Sealing tape 42 is adhered continuously around the periphery of each deltoid pad 26 and the right half 18 and left half 20 of padding layer 14 and is substantially the same width as padding layer 14. Thus, padding layer 14 includes four separate pieces before deltoid pads 26 are hinged to the respective right or left half 18 or 20.

Figure 7:
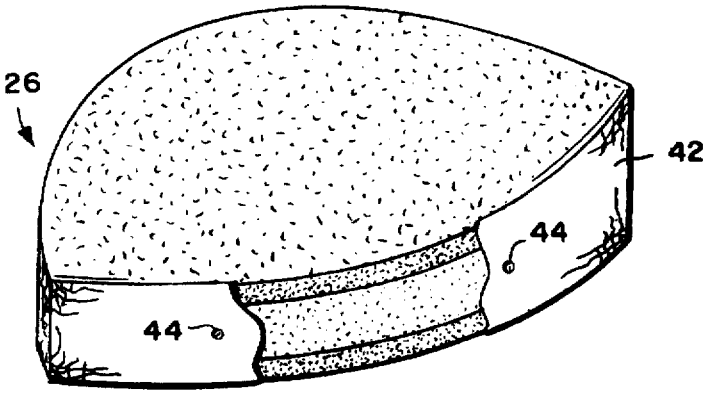
FIG. 7 is a perspective view of a deltoid pad broken away to show the foam configuration and sealing tape thereof.
Figure 10:
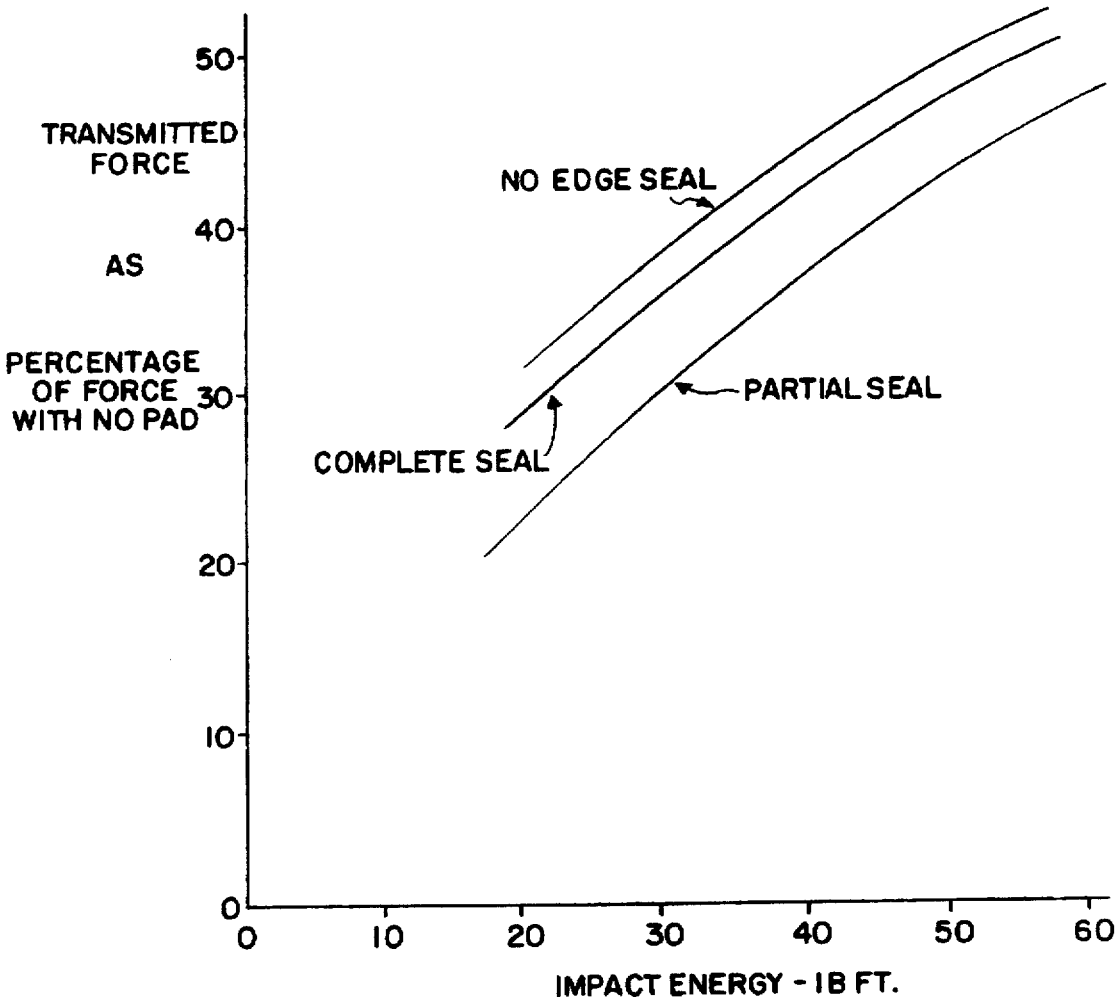
FIG. 10 is a graph showing the reduction of transmitted force by partially sealing the padding.

Sealing tape 42 has spaced apart air passages 44 extending therethrough in a longitudinal row at the center thereof, as in FIG. 7. Air passages 44 thus communicate with open cell layer 34 of padding 14, and sealing tape 42 only partially seals open cell padding layer 34 from releasing air. This allows minimum force to be transmitted upon impact by controlled venting so that both air pressure and foam properties combine to resist the impact. FIG. 10 shows the reduction of transmitted force by controlled air release, or in other words, when the padding is partially sealed as disclosed herein as compared to completely sealed padding (i.e., where tape is used having no holes therethrough) and unsealed padding (i.e., no tape or other seal member is used). Totally sealed padding transmits higher force than the controlled air release pad disclosed herein because during impact of a totally sealed pad, the air pressure increases to resist the impact, like an inflated auto tire. During impact of an unsealed pad, the open cell foam tends to bottom out and the closed cell foam resists the impact, like a deflated auto tire.

Air passages 44 are preferably approximately 1/32" in diameter and are spaced 4 inches apart. Ideally, the size of air passages 44 should match the dimensions of the protective pad 10 and the magnitude of the impact so that the padding 14 bottoms out at the peak of impact. But, practically, the magnitude of impact varies greatly in a football game. Thus, the ideal air passage specifications as disclosed herein are based on impact tests to establish preferred air release.

Figure 5:
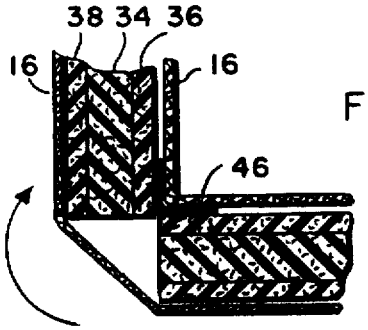
FIG. 5 is a cross-section of the pad as shown in FIG. 4 and illustrating the hinge action of a deltoid pad.

A hinge 46 rotatably connects each deltoid pad 26 to its corresponding left or right half 18 or 20 of padding 14. Each hinge 46 is formed by tape adhered to the outer surface of padding layer 14, which is shown in FIGS. 3, 4 and 5 as the outer surface of closed cell layer 36. Hinge tape 46 extends over the portion of the periphery of the deltoid pad 26 that is immediately adjacent its corresponding half 18 or 20 and over a portion of the corresponding left or right half 18 or 20 to provide a strip overlying both margins.

Figure 6:
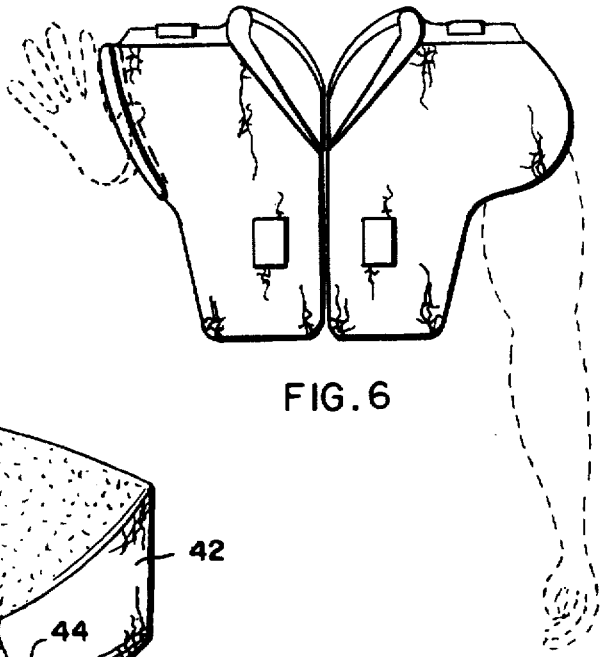
FIG. 6 is a frontal perspective view of the shoulder pad in accordance with the present invention showing the hinge action of one of its deltoid pads, with the hard outer layer removed for clarity.

The hinge/deltoid pad construction disclosed herein provides an advantageous one-way hinge action. Deltoid pad 26 rotates easily but only in the direction permitted by hinge 46, as seen in FIGS. 4–6. FIG. 4 shows deltoid pad 26 and hinge 46 in the rest position when the athlete's arm is immobile and hanging by his/her side. FIGS. 5 and 6 show the deltoid pad and hinge 46 in the active position, with the arm extended upwardly (as in FIG. 5) or forwardly (as in FIG. 6).

From the position in FIG. 5, hinge 46 allows deltoid pad to rotate in the return direction (counterclockwise) but only to the rest position shown in FIG. 4. Rotation of deltoid pad 26 rearwardly of hinge 46 is prevented by the engagement of the deltoid pad 26 with the separate padding which forms either the right or left half 18 or 20. Hinge 46 prevents deltoid pad 26 from being caught beneath the left or right half 18 or 20 when the wearer puts on the pad and, more importantly, when in use during a game. This ensures the deltoid and shoulder area will be protected at all times. Of course, this type of hinge construction is advantageous for other areas of protective padding as well.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An athletic protective pad, comprising:

a foam body composed of a layer of open cell foam and first and second layers of closed cell foam secured to opposing surfaces of said layer of open cell foam, said layers presenting a sandwich configuration;

means for partially sealing said foam body to control the release of air upon impact thereof, said means secured around said foam body's periphery;

said layer of open cell foam having a first thickness and each of said layers of closed cell foam having a second thickness; and said first thickness being approximately 1.5 to 2.0 times said second thicknesses to maximize the trapped air content within said layer of open cell foam;

said first thickness and said means for partially sealing maximizing impact resistance.

2. An athletic protective pad, comprising:

a foam body having a thickness composed of a layer of open cell foam and first and second layers of closed cell foam secured to opposing surfaces of said layer of open cell foam, said layers presenting a sandwich configuration;

means for partially sealing said foam body to control the release of air upon impact thereof, said means secured around said foam body's periphery;

said layer of open cell foam forming between 60 percent and 66 percent of said thickness of said foam body to maximize the trapped air content therewithin;

said layer of open cell foam and said means for partially sealing maximizing impact resistance.

3. An athletic protective pad as claimed in claim 2, further comprising:

a flexible air permeable enclosure defining a cavity into which said foam body is received.

4. An athletic protective pad as claimed in claim 2, wherein said means for partially sealing includes tape secured to said foam body's periphery, said tape having apertures therethrough spaced approximately 4 inches apart, each said aperture having approximately a 1/32" diameter.

5. An athletic protective pad, comprising:

a foam body composed of a layer of open cell foam and a first and second layer of closed cell foam and having a foam portion, a foam member and means for hingedly attaching said foam portion to said foam member, said foam portion and said foam member each presenting a periphery;

means for partially sealing said foam portion and said foam member, said means secured around said peripheries thereof to control the release of air upon impact thereof;

said means for hingedly attaching including tape attached to an outer surface of said foam body across a portion of said peripheries of said foam portion and said foam member to allow said foam member to rotate in a first direction relative to said foam portion and preventing rotation thereof in a second direction;

said first and second layers of closed cell foam being secured to opposing surfaces of said layer of open cell foam, said layers presenting a sandwich configuration;

said layer of open cell foam having a first thickness and each of said layers of closed cell foam having a second thickness; and said first thickness being approximately 1.5 to 2.0 times said second thicknesses to maximize the trapped air content within said layer of open cell foam;

said laver of open cell foam and said means for partially sealing maximizing impact resistance.

6. An athletic protective pad as claimed in claim 1, wherein said means for partially sealing includes tape secured to said foam body's periphery, said tape having apertures therethrough spaced approximately 4 inches apart, each said aperture having approximately a 1/32" diameter.

7. An athletic protective pad as claimed in claim 5, wherein said means for partially sealing includes tape secured to said foam body's periphery, said tape having apertures therethrough spaced approximately 4 inches apart, each said aperture having approximately a 1/32" diameter.

8. An athletic protective pad as claimed in claim 5, further comprising:

a flexible air permeable enclosure defining a cavity; and said foam body being within said cavity.

* * * * *